US008296901B2

(12) United States Patent
Rosenzweig et al.

(10) Patent No.: US 8,296,901 B2
(45) Date of Patent: Oct. 30, 2012

(54) RECONFIGURABLE AIRFLOW WAND

(75) Inventors: Mark Rosenzweig, Chestnut Hill, MA (US); Yigal Offir, Hopkinton, MA (US); James Russell Varney, Maynard, MA (US); Bryan Robert Hotaling, Harvard, MA (US); John A. MacNeill, Acton, MA (US)

(73) Assignee: Euro-Pro Operating LLC, Newton, MA (US)

( * ) Notice: Subject to any disclaimer, the term of this patent is extended or adjusted under 35 U.S.C. 154(b) by 1259 days.

(21) Appl. No.: 12/010,358

(22) Filed: Jan. 24, 2008

(65) Prior Publication Data

US 2009/0188997 A1 Jul. 30, 2009

(51) Int. Cl.
*A47L 9/24* (2006.01)

(52) U.S. Cl. ..... 15/414; 15/410; 285/7; 285/80; 285/86; 285/87; 285/305

(58) Field of Classification Search ..... 15/410, 15/414; 285/7, 80, 86, 87, 305; *A47I 9/24*
See application file for complete search history.

(56) References Cited

U.S. PATENT DOCUMENTS

| | | | |
|---|---|---|---|
| 5,472,346 | A | 12/1995 | Gray et al. |
| 5,927,758 | A | 7/1999 | Carlsson |
| 5,996,175 | A | 12/1999 | Fusco |
| 6,032,321 | A | 3/2000 | Shirey et al. |
| 6,209,925 | B1 | 4/2001 | Edin |
| 6,301,740 | B1 | 10/2001 | Quiroz |
| 6,317,920 | B1 | 11/2001 | Brickner et al. |
| 6,345,408 | B1 | 2/2002 | Nagai et al. |
| 6,382,058 | B1 | 5/2002 | Owoc |
| 6,553,613 | B2 | 4/2003 | Onishi et al. |
| 6,561,549 | B1 | 5/2003 | Moris et al. |
| 6,581,974 | B1 | 6/2003 | Ragner et al. |
| 6,695,352 | B2 | 2/2004 | Park et al. |
| 6,768,073 | B1 | 7/2004 | Tondra et al. |
| 6,904,640 | B2 | 6/2005 | Jin et al. |
| 7,000,288 | B2 | 2/2006 | Nighy |
| 7,055,204 | B2 | 6/2006 | Ajluni |
| 7,162,796 | B2 | 1/2007 | Wark et al. |
| 7,168,128 | B2 | 1/2007 | Evans |
| 7,219,390 | B2 | 5/2007 | Johnson et al. |
| 7,350,263 | B2 | 4/2008 | Yoshimi et al. |
| 7,496,984 | B2 | 3/2009 | Pang |
| 2002/0078519 | A1 | 6/2002 | Boothby |
| 2002/0101075 | A1 | 8/2002 | Park et al. |
| 2003/0163891 | A1 | 9/2003 | Nagai et al. |
| 2003/0167595 | A1 | 9/2003 | Jin et al. |
| 2004/0007278 | A1 | 1/2004 | Williams |

(Continued)

FOREIGN PATENT DOCUMENTS

| | | |
|---|---|---|
| AU | 671764 | 3/1995 |

(Continued)

OTHER PUBLICATIONS

European Search Report of EP 09 15 0898 mailed May 20, 2010.

*Primary Examiner* — David Redding
(74) *Attorney, Agent, or Firm* — Wolf, Greenfield & Sacks, P.C.

(57) ABSTRACT

A wand, such as for a surface cleaning apparatus, comprises at least an upstream rigid tube and a downstream rigid tube releasably pivotally connected to the upstream rigid tube. A flexible fluid flow conduit connects the downstream, tube in fluid flow communication with the upstream tube.

13 Claims, 7 Drawing Sheets

U.S. PATENT DOCUMENTS

| | | | |
|---|---|---|---|
| 2004/0163202 | A1 | 8/2004 | Yoshimi et al. |
| 2004/0211029 | A1 | 10/2004 | Ueda |
| 2004/0244131 | A1 | 12/2004 | Cassar |
| 2005/0081326 | A1 | 4/2005 | Jeon |
| 2005/0115017 | A1 | 6/2005 | Kim |
| 2005/0115018 | A1 | 6/2005 | Jeon |
| 2005/0125944 | A1 | 6/2005 | Ji |
| 2005/0125945 | A1 | 6/2005 | Park |
| 2006/0156509 | A1 | 7/2006 | Luebbering et al. |
| 2006/0156510 | A1 | 7/2006 | Park et al. |
| 2006/0242775 | A1 | 11/2006 | Ho |
| 2007/0174994 | A1 | 8/2007 | Allard et al. |

FOREIGN PATENT DOCUMENTS

| | | | |
|---|---|---|---|
| DE | 3913419 | A1 | 10/1990 |
| EP | 1 226 777 | B1 | 3/2005 |
| EP | 1 764 021 | A1 | 3/2007 |
| GB | 613995 | | 12/1948 |
| WO | WO 00/65978 | | 11/2000 |
| WO | WO 2005/034706 | A2 | 4/2005 |
| WO | WO 2007/086798 | A1 | 8/2007 |

RECONFIGURABLE AIRFLOW WAND

FIELD

This application relates to an air or fluid flow tube, such as a wand for a surface cleaning apparatus, which is bendable. In one particular embodiment, this application relates to surface cleaning apparatus which utilize a wand extending between a surface cleaning head or tool and a cleaning unit, such as may be used in a canister vacuum cleaner or in an above floor cleaning wand.

BACKGROUND

Canister vacuum cleaners typically comprise a main canister body, which is connected in fluid flow communication with a surface cleaning head by means of a rigid wand and a flexible hose extending between the wand and the canister body. The rigid wand comprises the handle for directing a surface cleaning head over a floor to be cleaned. In addition, the wand comprises the airflow conduit from the surface cleaning head to the canister body. The surface cleaning head may have a dirty air outlet nozzle, which is pivotally mounted to the rigid wand. Accordingly, in order to permit a user to clean under, e.g., a sofa, bed or the like, a user may bend down or crouch down so as to extend the wand generally horizontally. In this orientation, the cleaning head may be maneuvered under furniture.

One disadvantage of this design is that the user must have sufficient maneuverability so as to position the wand generally parallel to, and proximate, the floor so as to enable the cleaning head to be maneuvered under furniture having a low ground clearance. However, not all users may have this maneuverability. Accordingly, it has been proposed to provide a wand or extension tube which is bendable. See for example U.S. Pat. No. 6,695,352 (Park et al.). Park et al. discloses an extension tube for a vacuum cleaner which utilizes first and second tubes, each of which has a coupling part provided thereon. The coupling parts inter-engage to define a rotatable joint which defines the airflow passage from one tube to the next. Other designs which have been developed include U.S. Pat. No. 5,927,758 (Carlsson) and U.S. Pat. No. 6,209,925 (Edin). Each of these patents also discloses a reconfigurable extension tube wherein the rotatable joint also comprises part of the airflow passage.

SUMMARY

In accordance with the instant invention, a simplified construction for a moveable coupling for an extension wand for, e.g., a vacuum cleaner, which is bendable, is provided. A bendable wand has at least two operation modes. In a first mode, the wand has at least two sections that are held in a fixed position such that the sections may be used to guide a surface cleaning head or other tool across a surface to be cleaned. In a second mode, at least two sections are moved relative to each other such that the wand may be used to guide a surface cleaning head or other cleaning tool under furniture having a low ground clearance. In the first mode, the two sections, or tubes, may extend generally in a straight line (linearly). In the second mode, the first section may pivot freely with respect to a second section. Optionally, the sections may be lockable in any orientation achieved in the second mode.

In accordance with this construction, an upstream tube and a downstream tube are connected in fluid flow communication by a flexible conduit. Instead of utilizing the airflow passage between the tubes as the pivotable joint or connector that provides the or at least some of the structural strength such that movement of the downstream wand controls movement of the upstream wand as in the prior art, separate members are utilized to permit the tubes to provide at least some of, and preferably all of, this structural strength. For example, each of the tubes may have provided thereon, or incorporated as part thereof, structure members which, when joined together, permit one tube to move (e.g. pivot), with respect to the other tube and also provide structural strength such that the tubes may be used to guide a surface cleaning tool over a floor in either the first mode and the second mode. Therefore, in a locked or first mode, the upstream and downstream tubes are rigidly connected together such that the tubes may function as a single elongate tube. In the second mode, the tubes may be at an angle to each other and used to guide a surface cleaning tool under furniture having a low ground clearance with the user being able to remain optionally upright, if the downstream tube is sufficiently long.

One advantage of this design is that the pivot joint itself is defined by structural members that do not have a moveable seal. In the design of Park et al., the joint is defined by inter-engaged, rotatable connectors. Accordingly, in order to maintain an airtight fluid flow passage a rotatable seal must be utilized. In other words, when the upstream tube is rotated with respect to the downstream tube, one coupling member slides within the other coupling member. The seals which are utilized in this design must maintain a relatively airtight seal during this rotational movement. Such seals may wear out over time. In contrast, in accordance with the instant invention, a flexible conduit, which need not be a load bearing member (e.g. may be a flexible hose), is utilized to connect the upstream and downstream tubes in fluid flow communication but not to define the construction which is utilized to control the rotation of the upstream tube with respect to the downstream tube and to permit the downstream tube to be used to steer the upstream tube. Accordingly, no moveable seal need be utilized in accordance with this design.

It will be appreciated that this wand design may be used with any surface cleaning apparatus. Alternately, this design may be used with any appliance that uses an air or fluid flow tube that can bend. For example, this wand design may be used with a blower.

In accordance with one aspect of this invention, there is provided a wand, preferably for a surface cleaning apparatus, comprising:

(a) an upstream rigid tube having an upstream end and a downstream end;

(b) a downstream rigid tube releasably pivotally connected to the upstream rigid tube and having an upstream end and a downstream end; and, (c) a flexible fluid flow conduit connecting the upstream end of the downstream tube in fluid flow communication with the downstream end of the upstream tube.

In one embodiment, the wand further comprises a lock securing the upstream and the downstream rigid tubes in a fixed orientation. In any such embodiment, the wand may further comprise a lock release actuator positioned remote to the lock. For example, the wand may further comprise a handle associated with the downstream rigid tube and the lock release actuator is positioned proximate the handle. If a handle is provided, then, preferably, the handle is positioned proximate the downstream end of the downstream rigid tube.

In some embodiments, the upstream rigid tube is pivotally connected to the downstream rigid tube at a position proximate the upstream end of the downstream rigid tube.

In some embodiments, the downstream end of the upstream rigid tube has a first connector associated therewith and the upstream end of the downstream rigid tube has a second connector associated therewith and the first and second connectors are pivotally connected together. In some embodiments, the first connector is secured to the upstream rigid tube and the second connector is secured to the downstream rigid tube. Alternately, or in addition, the wand may further comprise a lock securing the upstream and the downstream rigid tubes in a fixed orientation, the lock comprising a member extending from at least one of the downstream rigid tube and the second connector and releasably engageable with at least one of the upstream rigid tube and the first connector. In any such embodiment, the wand may further comprise a lock release actuator positioned remote to the lock. For example, the wand may further comprise a handle associated with the downstream rigid tube and the lock release actuator is positioned proximate the handle. If a handle is provided, then, preferably, the handle is positioned proximate the downstream end of the downstream rigid tube.

In accordance with another aspect of this invention, there is provided a wand, preferably for a surface cleaning apparatus, comprising:

(a) an upstream rigid tube having a fluid flow passage having an upstream end and a downstream end;

(b) a downstream rigid tube having a fluid flow passage having an upstream end and a downstream end;

(c) the downstream rigid tube being moveably connected to the upstream rigid tube between a first position in which the upstream rigid tube is positioned in a fixed orientation with respect to the downstream rigid tube and a second position in which the upstream rigid tube is at an angle to the downstream rigid tube; and, (d) a flexible fluid flow conduit extending between the upstream end of the fluid flow passage of the downstream tube and the downstream end of the fluid flow passage of the upstream tube.

In one embodiment, the upstream rigid tube is pivotally connected to the downstream rigid tube.

In some embodiments, the wand further comprises a lock releasably securing the upstream and the downstream rigid tubes in the first position. Preferably, the lock release actuator is positioned remote to the lock.

In some of these embodiments, the wand further comprises a handle associated with the downstream rigid tube and the lock release actuator is positioned proximate the handle. Preferably, the handle is positioned proximate the downstream end of the fluid flow passage of the downstream rigid tube.

In some of these embodiments, the upstream rigid tube is pivotally connected to the downstream rigid tube at a position proximate the upstream end of the fluid flow passage of the downstream rigid tube.

In some of these embodiments, the upstream rigid tube has a downstream end having a first connector associated therewith and the downstream rigid tube has an upstream end having a second connector associated therewith and the first and second connectors are pivotally connected together. Preferably, the first connector is secured to the upstream rigid tube and the second connector is secured to the downstream rigid tube.

In some of these embodiments, the wand further comprises a lock securing the upstream and the downstream rigid tubes in the first position, the lock comprising a member extending from at least one of the downstream rigid tube and the second connector and releasably engageable with at least one of the upstream rigid tube and the first connector. Preferably, a lock release actuator positioned remote to the lock. Preferably, a handle associated with the downstream rigid tube and the lock release actuator is positioned proximate the handle.

DESCRIPTION

These and other advantages of the present invention will be more fully and particularly understood in connection with the following description of the preferred embodiments of the invention in which.

DESCRIPTION

Figure 1:
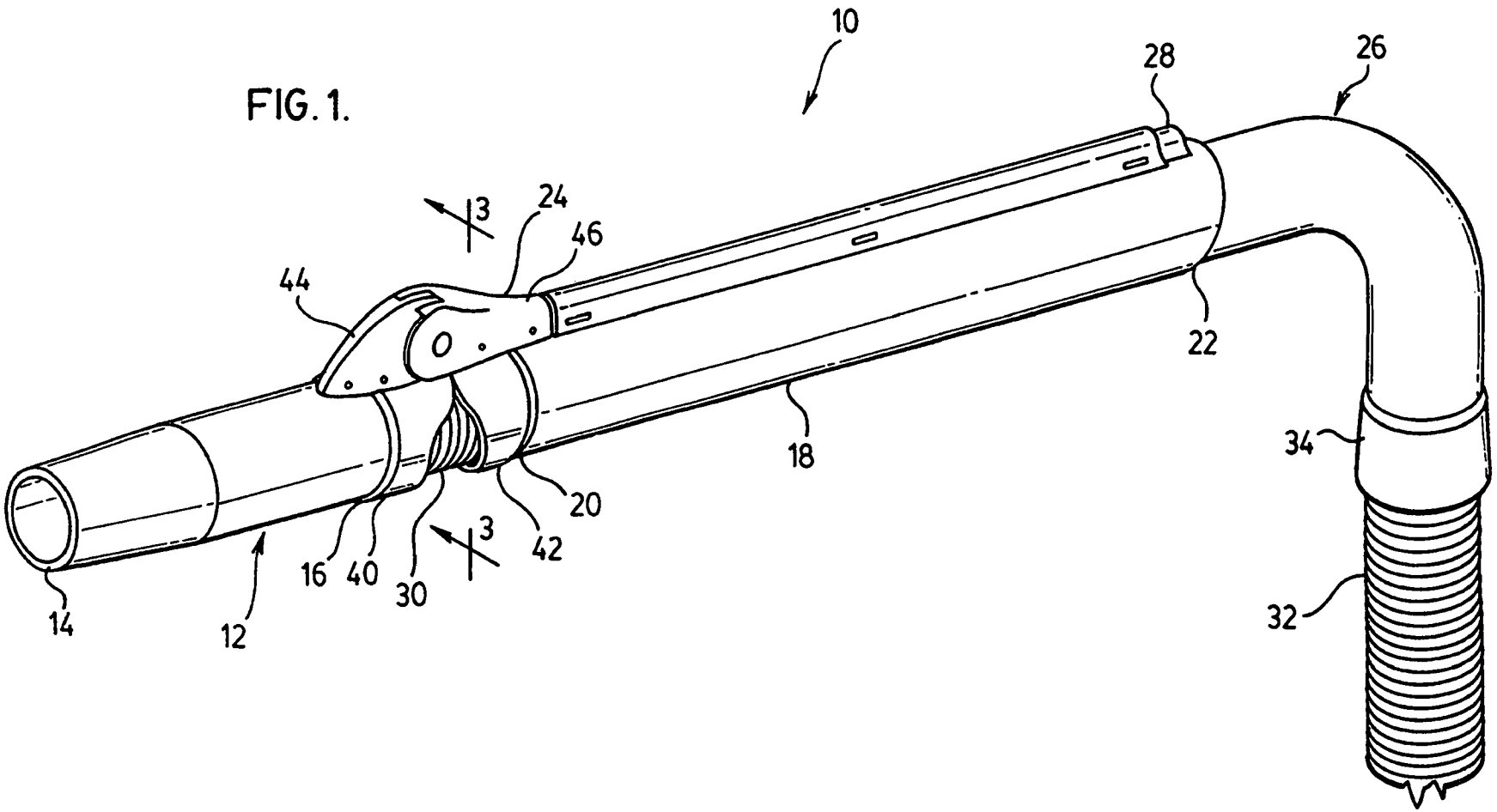
FIG. 1 is a perspective view of a wand according to a first embodiment to the instant invention.

Referring to the embodiment of FIGS. 1-5, wand 10 comprises upstream tube 12, having upstream end 14 and downstream end 16, and downstream tube 18, having upstream end 20 and downstream end 22. Upstream tube 12 and downstream tube 18 are moveably connected together by means of a rotatable joint 24. Upstream tube 12 and downstream tube 18 are connected in fluid flow communication by a flexible fluid flow conduit 30. A handle 26 for maneuvering wand 10 is preferably provided. Preferably, a lock release actuator 28 is positioned adjacent handle 26.

Each of upstream and downstream tubes 12 and 18 may be of any particular length and may be made of any rigid material (e.g. plastic or metal). Upstream end 14 of upstream tube 12 may be a nozzle for cleaning a surface. Alternately, or in addition, it may be adapted to receive a surface cleaning tool, such as a surface cleaning head, additional extension tube, crevice cleaning tool or the like. Downstream end 22 of downstream tube 18 may be connected directly with a cleaner body or may be connected thereto via a flexible hose 32.

Flexible hose 32 may be any flexible hose or conduit known in the surface cleaning arts. For example, flexible hose 32 may be a plastic hose with a reinforcing member secured thereto in a spiral pattern.

Figure 2:
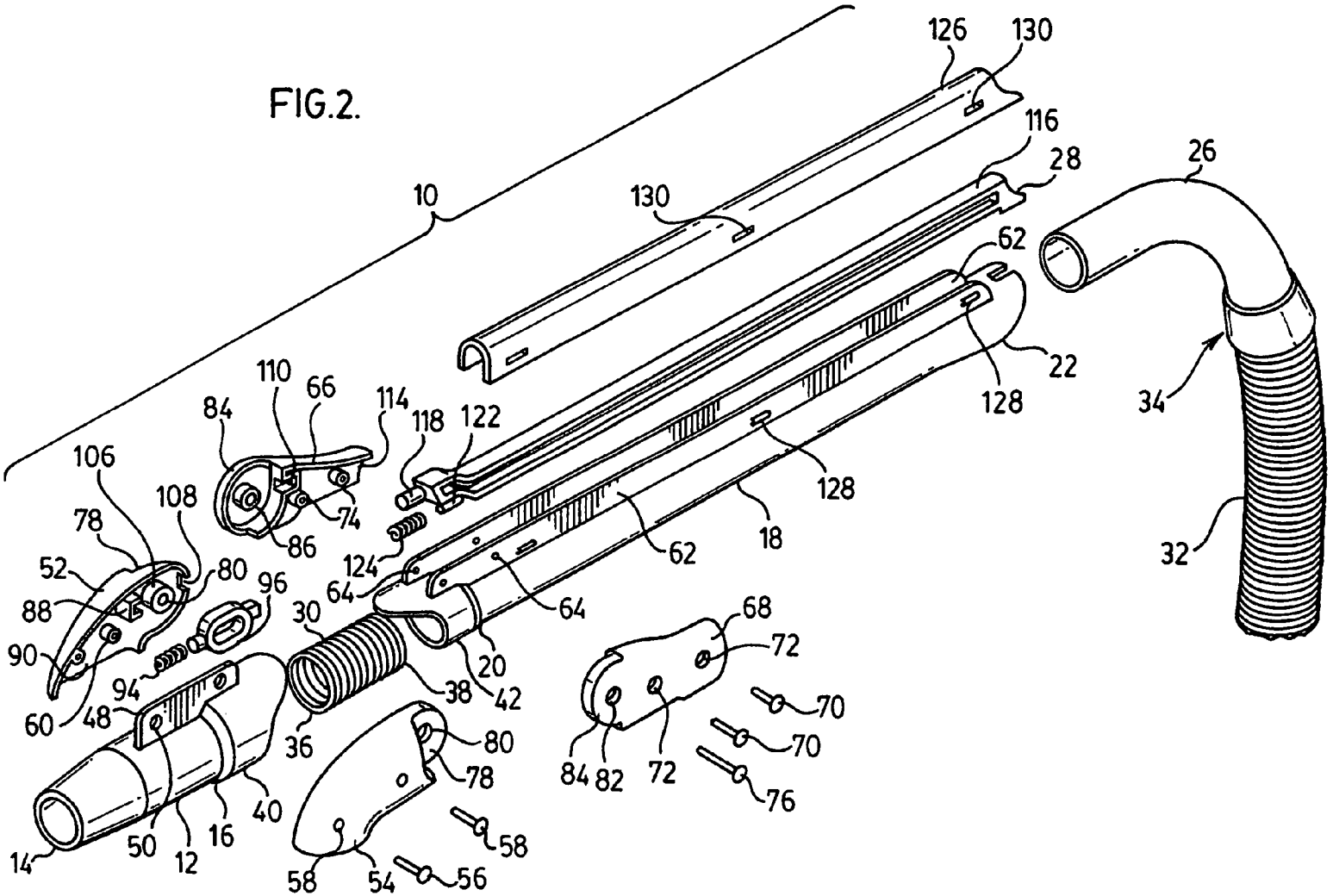
FIG. 2 is a exploded view of the wand of FIG. 1.

As exemplified in FIG. 2, the upstream end 34 of flexible tube 32 may have a handle 26 affixed thereto. Accordingly, handle 26 comprises an intermediary component between downstream tube 18 and flexible hose 32. It will be appreciated that, in an alternate construction, flexible hose 32 may be connected directly with downstream end 22 of tube 18. It will be appreciated that in such a construction, handle 26 may be incorporated as part of tube 18, tube 18 may be used as the handle or the handle may be a separate component mounted thereto.

Flexible fluid flow conduit 30 (which is preferably a flexible hose) connects downstream end 26 of upstream tube 12 in fluid flow communication with upstream end 20 of downstream tube 18. Accordingly, in operation, air is drawn into wand 10 via upstream end 14 and travels through upstream tube 12 (which define am upstream passage) through flexible fluid flow conduit 30, through downstream tube 18 (which define am downstream passage) through flexible hose 32 to the cleaning unit of a surface cleaning apparatus. Additional intermediary members may be provided in the fluid flow path from the dirty fluid inlet (e.g., the inlet of a surface cleaning head) to the cleaning unit.

It will be appreciated that the surface cleaning apparatus may be any surface cleaning apparatus known in the art, such as an upright vacuum cleaner, canister vacuum cleaner, backpack vacuum cleaner, wet-dry vacuum cleaner or the like. If, for example, wand 10 is utilized with a canister or backpack vacuum cleaner, then it will be appreciated that wand 10 may be utilized as the extension tube that is steeringly connected to the surface cleaning head as is known in the art. Alternately, if the surface cleaning apparatus is an upright vacuum cleaner, then wand 10 may comprise an above floor cleaning wand. Accordingly, it will be appreciated that hose 32 may be secured to a surface cleaning apparatus by any means known in the art and wand 10 may optionally be removably mounted to the surface cleaning apparatus.

Flexible fluid flow conduit 30 may be secured to tubes 12 and 18 by any means known in the art. For example, upstream end 36 of conduit 30 may be secured to downstream end 16 of tube 12 by a flexible cuff provided on end 36, which is slipped over end 16. Alternately, or in addition, upstream end 36 may be secured to tube 12 by an adhesive, an O-ring clamp, a friction fit or any other means known in the art. Similarly, downstream end 38 of conduit 30 may be secured to upstream end 20 of tube 18. Alternately, or in addition, a collar or cuff 40 may be provided on downstream end 16 of tube 12 and/or a collar or cuff 42 may be provided on upstream end 20 of tube 18. In such a case, collar 40 may be used to secure upstream end 36 to tube 12 and collar 42 may be used to secure downstream end 38 to tube 18. Collars 40, 42 may be separately molded elements which are affixed to tubes 12, 18 by a friction fit, an adhesive, a set screw or the like. Conduit 30 may be slipped over end 16 of tube 12 and collar 40 mounted thereover so as to secure conduit 30 to tube 12. Alternately, collar 40 may have a mounting member for receiving upstream end 36. Accordingly, collar 40 could include an airflow passage there through. Similarly, collar 42 may be used to secure downstream end 38 to tube 18. It will be appreciated by those skilled in the art that various mounting means may be used and that this invention is not limited by the particular mounting means which is selected.

As exemplified in FIG. 1, rotatable joint 24 comprises a first connector 44 which is associated with downstream end 16 of tube 12 and the second connector 46 associated with upstream end 20 of tube 18. First and second connectors 44, 46 may be secured to tubes 12 and 18 by any means known in the art and may be moveably mounted with respect to each other by any means known in the art. Preferably, as exemplified in FIGS. 2-5, first and second connectors 44, 46 are pivotably mounted together.

As exemplified in FIG. 2, tube 12 is provided with a flange 48 having openings 50. Flange 48 may be secured to tube 12 by any means known in the art. For example, flange 50 may be secured to tube 12 by means of an adhesive, welding, screws or it may be formed integrally as part as tube 12. Connector 44 comprises first and second halves 52, 54, which may be secured together by screws 56, rivets, an adhesive, welding or other means. Screw 56 passes through opening 58 in second half 54, through opening 50 and is received in screw mount 60, which is provided on the inner surface of first half 52 of first connector 44. Accordingly, flange 48 is used to secure first connector 44 to tube 12. It will be appreciated that first and second halves 52, 54 may be secured to tube 12 by any other means such as by an adhesive, welding, mechanical attachment or other means directly connecting first and second halves 52, 54 directly to tube 12.

Second connector 46 may be similarly mounted to tube 18. For example, tube 18 may be provided with two flanges 62 each of which may be provided with one or more openings 64. Second connector 46 may accordingly comprise first and second halves 66, 68 and be secured together by means of one or more screws 70 extending through opening 72 in second half 68, through openings 64 in flanges 62, into screw mount 74 provided on the inner surface of first half 66.

First and second connectors 44, 46 may be pivotally secured together by means of pivot screw 76. For example, each of first of second halves 52, 54 may have a recessed surface 78 having an opening 80 therein. First and second halves 66, 68 may also be provided with an opening 82 in mounting portion 84 thereof. Mounting portions 84 are spaced apart when first and second halves 66, 68 are secured together on tube 18. Accordingly, once first and second halves 52, 54 have been secured to tube 12, recessed surfaces 78 may be inserted into the gap between mounting portions 84 and openings 80 and 82 aligned so that pivot screw 76 may extend through opening 82 in second half 68, through opening 80 in second half 54, through opening 80 in first half 52 and into screw mount 86. Accordingly, when assembled, first and second connectors 44, 46 are secured to tubes 12 and 18 essentially as part of an exoskeleton, and provide the pivot mount for pivotally connecting tubes 12 and 18 together.

It will be appreciated that other methods of pivotally connecting first and second connectors 44, 46 may be used and that first and second connectors 44, 46 may be of varying designs.

Optionally, wand 10 includes a lock to secure wand 10 in at least one orientation. For example, as shown in FIG. 1, tubes 12 and 18 extend linearly in accordance with a first mode or orientation such that the upstream and downstream flow passages provided therein extend essentially linearly (e.g. along the same longitudinal axis). Preferably, a lock is provided to secure tubes 12 and 18 in this fixed orientation, which is particularly useful for moving a surface cleaning head over a floor to be cleaned. Any locking means known in the art may be used.

Ax exemplified lock is shown in FIG. 2. As exemplified therein, first half 52 is provided with a C-shaped flange 88 on inner surface 90. A similar C-shaped flange may be provided on the inner surface of second half 54. Accordingly, when assembled, the C-shaped flanges 88 define a pocket 92 for receiving spring 94. Lock member 96 is moveably mounted in first connector 44 and is provided with extension 98 and locking portion 100. As shown in particular in FIGS. 3 and 4, lock member 96 has an oblong internal opening 102 which seats on outer surface 104 of mount 106. It will be appreciated that a mount 106 may be provided on the inner surface of recessed surface 78 of second half 54. Extension 98 is preferably tubular in shape and is seated within one end of spring 94. Accordingly, spring 94 is positioned on extension 98 and then inserted into pocket 92 thereby securing spring 94 in position. In order to accommodate locking member 96, a slot 108 may be provided in the downstream side of first and second halves 52. First and second halves 66, 68 have a pocket 112 for receiving locking portion 100. Pocket 112 may be formed, for example, by a C-shaped flange 110 provided on inner surface 116 of each of first and second halves 66, 68.

Figure 3:
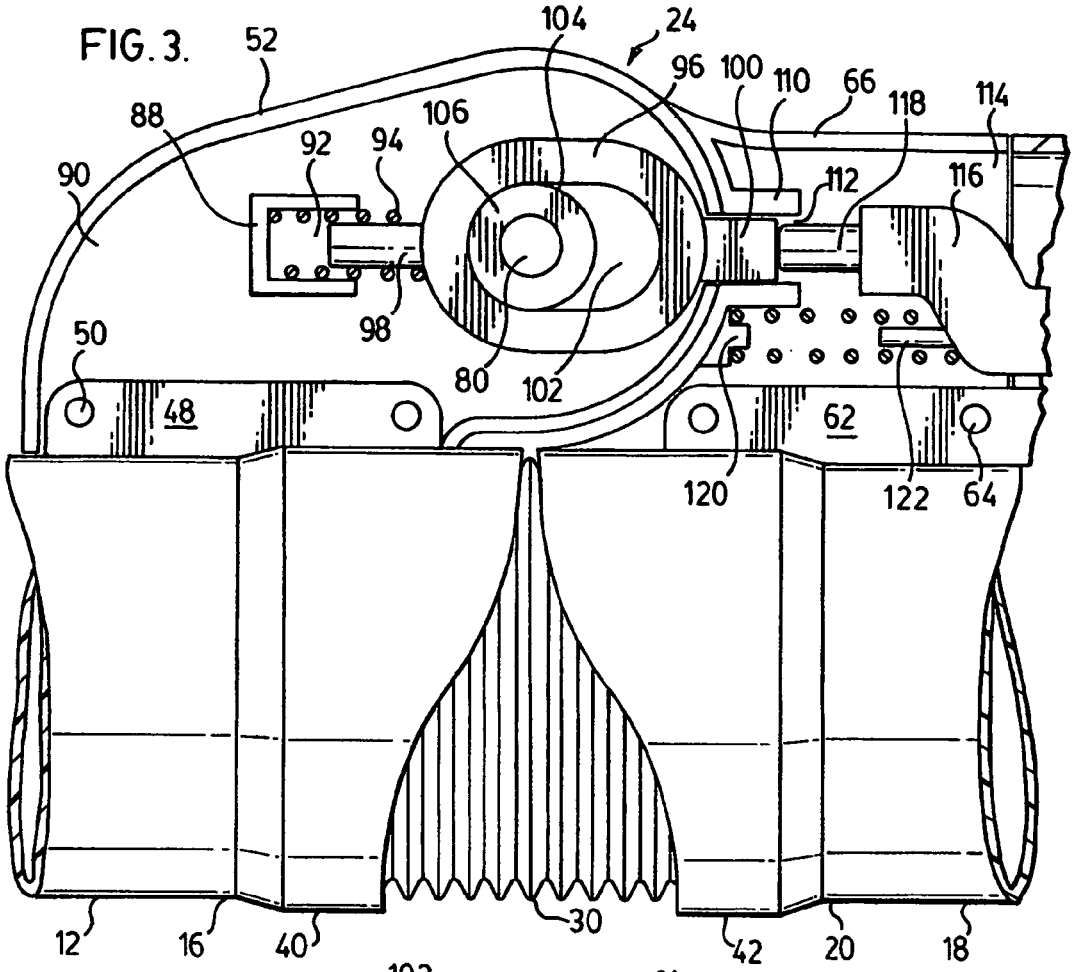
FIG. 3 is a cross-sectional view along the line 3-3 of FIG. 1 of the rotatable joint showing the lock in the locked position.

As shown in FIG. 3, the locking member is in the locked position. Accordingly, spring 94 presses against extension 98 forcing locking member 96 in the downstream direction thereby maintaining lock member 96 in pocket 112. Accordingly, locking portion 100 prevents first connector 44 from rotating with respect to the second connector 46. When locking portion 100 is removed from pocket 112 (to the position shown in FIG. 4), then first connector 44 may rotate with respect to second connector 46 (see for example FIG. 5).

Figure 4:
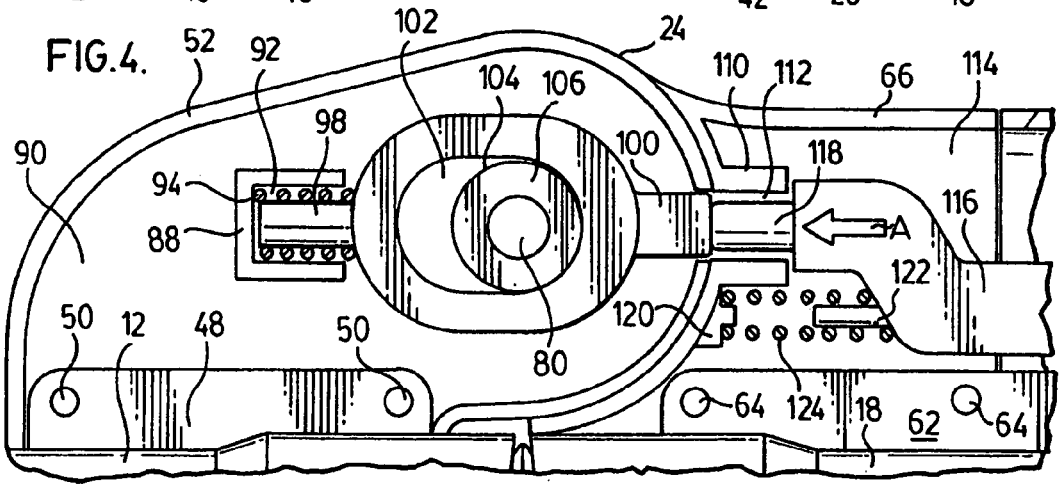
FIG. 4 is a cross-sectional view along the line 3-3 of FIG. 1 of the rotatable joint showing the lock in the unlocked position.
Figure 5:
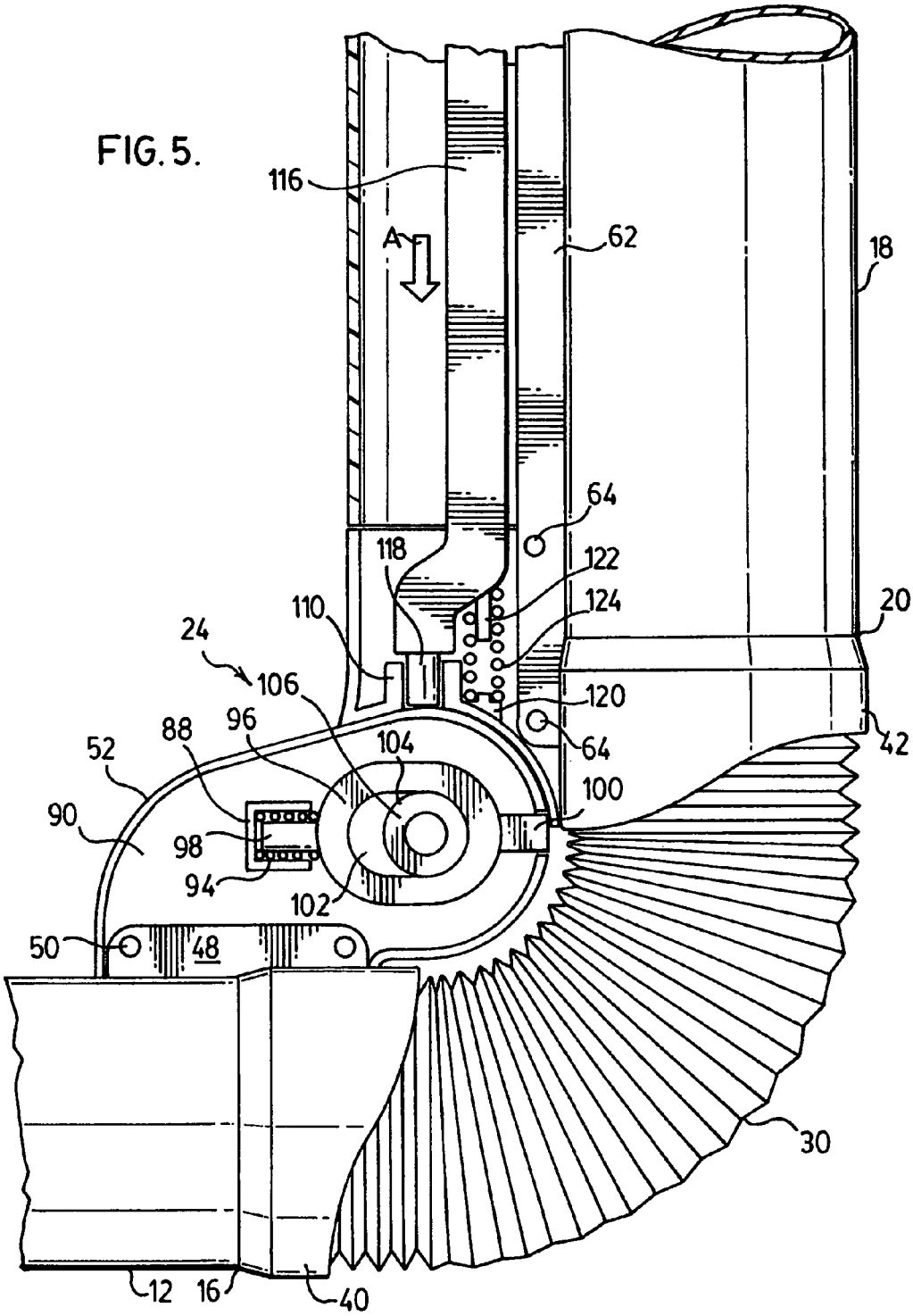
FIG. 5 is a cross-sectional view along the line 3-3 of FIG. 1 showing the upstream tube pivoted at an angle of about 90° to the downstream tube.
Figure 6:
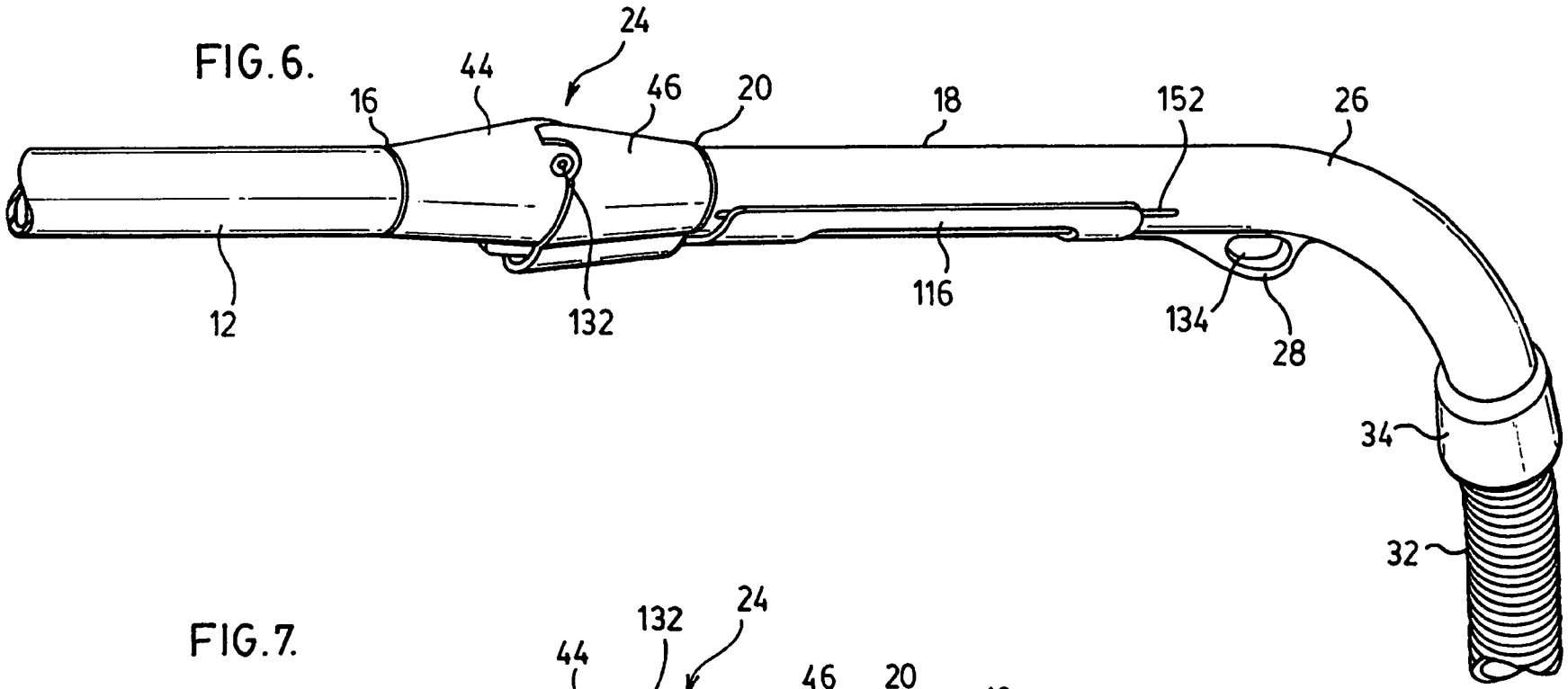
FIG. 6 is a perspective view of an alternate embodiment according to the instant invention.

Locking member 96 may be moved between the locked position shown in FIG. 3 and the unlock position shown in FIG. 4 by any means known in the art, such as a lock release actuator. Preferably, lock release actuator 28 is positioned distal to rotatable joint 24 and, more preferably, adjacent to handle 26. Accordingly, a linkage 116 may be provided such that lock release actuator 28 may remotely actuate the lock. As exemplified, linkage 116 has lock release actuator 28 provided at one end thereof and driving member 118 provided at an opposed end thereof. Actuator 28 and driving member 118 may be integrally formed as part of linkage 116 or may be separate elements. If tube 18 is provided with two flanges 62, then flanges 62 may be spaced apart to define a channel within which linkage 116 is slideably mounted. Accordingly, when linkage 116 is moved in the direction of arrow A in FIGS. 4 and 5, then driving member 118 will drive locking portion to the unlocked position shown in FIG. 4. It will be appreciated that only one flange 62 may alternately be used and, for example, linkage 116 may have a channel in its tube side in which flange 62 is slideably received.

Preferably, linkage 116 is biased to the locked position shown in FIG. 3. Accordingly, a biasing member may be provided to urge actuator 28 into the locked position. For example, inner surface 114 of first and/or second half 66, 68 may be provided with an abutment member 120. Similarly, linkage 116 may be provided with a spring mount or abutment member 122. Spring 124 may be positioned between abutment members 120, 122. Accordingly, when a user desires to rotate upstream tube 12, the user may press actuator 28 moving linkage 116 in the direction of arrow A thereby compressing spring 124 and moving locking portion 100 into the unlocked position thereby permitting upstream tube 12 to rotate. When a user releases actuator 12, spring 124 will drive linkage 116 into the locked position. Concurrently, spring 94 will move locking member into the locked position (i.e. driving locking portion 100 into pocket 112).

A cap 126 or other cover may be provided for covering linkage 112. Cap 126 may be secured to tube 18 by any means known in the art and may be of any desired shape. For example, as exemplified in FIG. 2, cap 126 is designed to seat on flanges 62, such as by having members 128 removably receivable in openings 130. Accordingly, cap 126 may be secured in place by positioning cap 126 over flanges 62 and pressing downwardly such that members 128 are received in openings 130. It will be appreciated that cap 126 may extend around all or a portion of tube 18 and may be secured thereto by any means known in the art, such as by means of an adhesive, welding, screws, clamps or the like.

Figure 7:
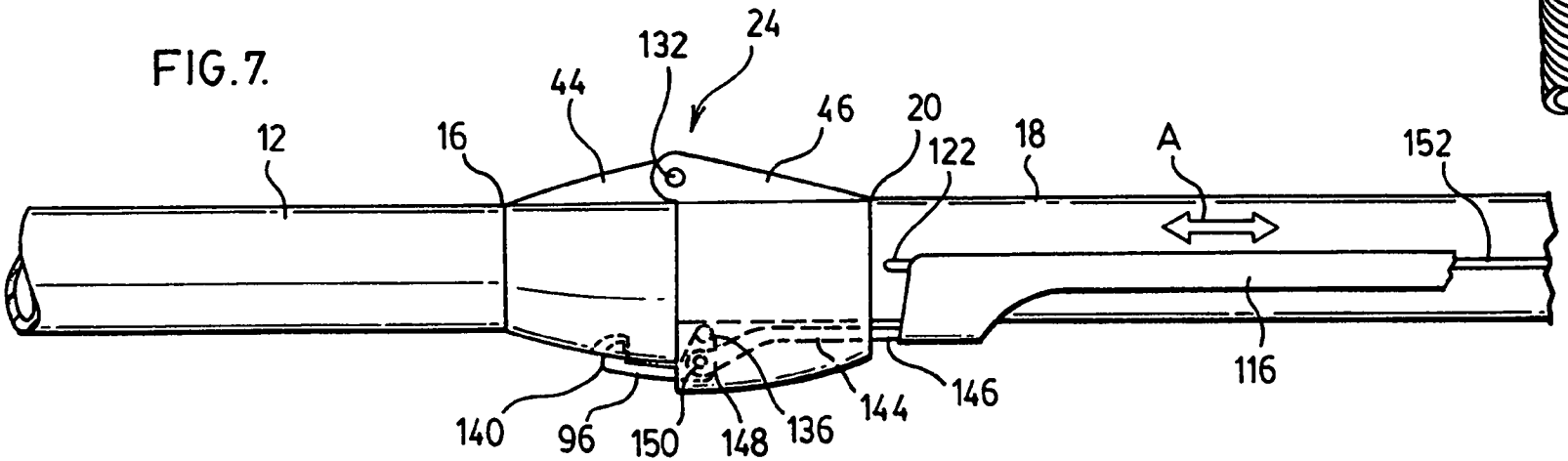
FIG. 7 is a side view of the embodiment of FIG. 6.
Figure 8:
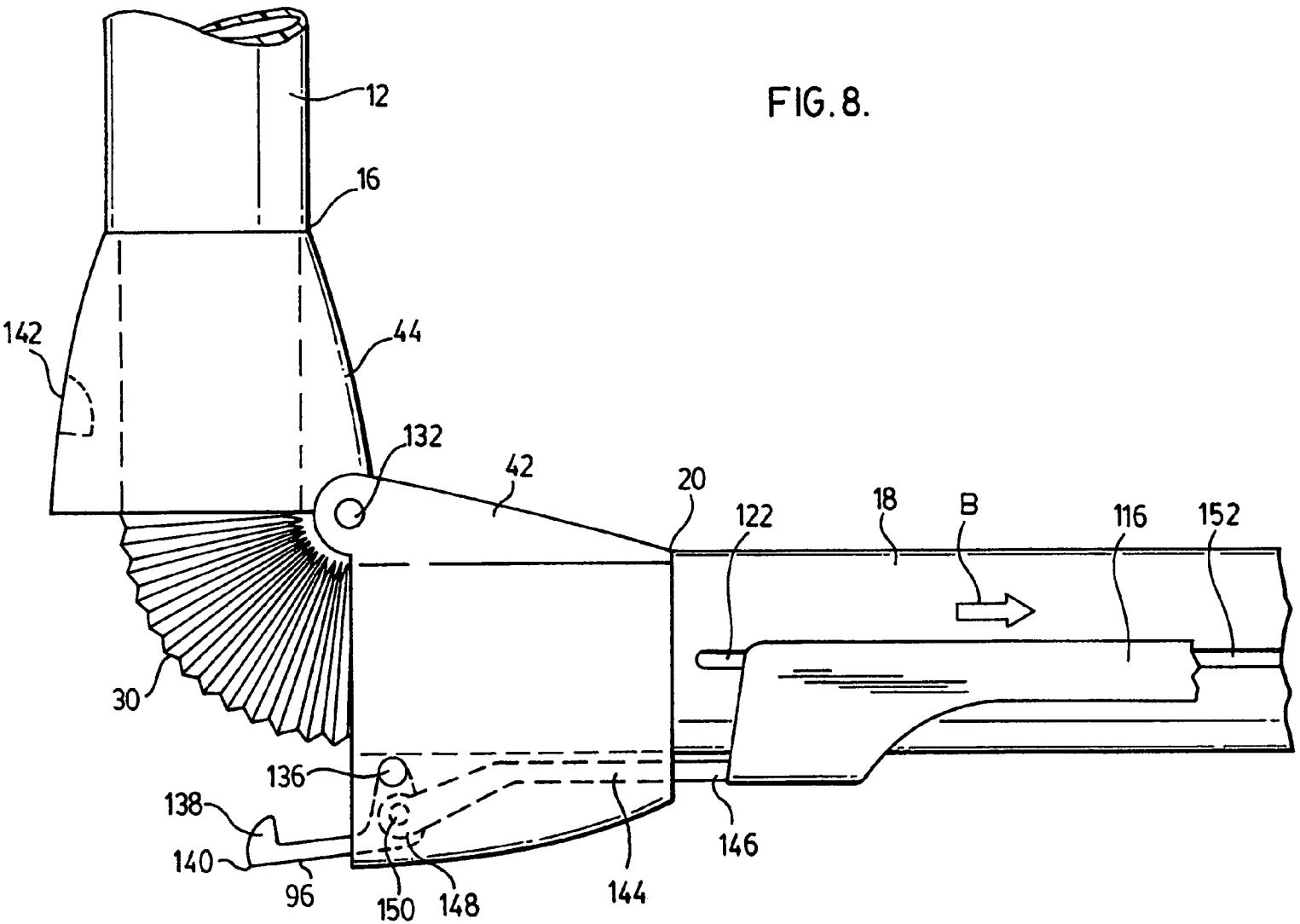
FIG. 8 is an enlarged view of the rotatable joint of FIG. 7 showing the upstream tube bent at an angle of about 90° to the downstream tube; and, FIG. 9 is a perspective view of a second alternate embodiment according to the instant invention.

FIGS. 7 and 8 exemplify an alternate embodiment. Having similar function are referred to using the same reference number in FIGS. 7 and 8.

In this alternate embodiment, first and second connectors 44, 46 are pivotably mounted together by pivot pin 132. First and second connectors are configured as collars which are provided on downstream end 16 of upstream tube 12 and on upstream end 20 of downstream tube 18. Actuator 28 comprises a trigger-like member which has an opening 134 for receiving a finger of a user. Locking member 96 is pivotably mounted about pivot pin 136 and has a hook 138 provided at distal end 140 of locking member 96. Hook 138 is removably received in recess 142 of first connector 44. Arm 144 has a first end 146 secured to linkage 116 and a second end 148 that is pivotably mounted to locking member 96 by pivot pin 150. A channel 152 is provided in tube 18 in which a portion of linkage 116 is seated so as to permit longitudinal movement in the direction of arrow A of FIG. 5. In operation, a user may use actuator 28 to move linkage 116 longitudinally along tube 18 in the direction of arrow B shown in FIG. 8. Movement of linkage 116 in the downstream fluid flow direction causes arm 144 to apply a force to locking member 96 causing locking member 96 to pivot around pivot pin 116 thereby rotating hook 138 out of recess 142. This permits tube 12 to rotate about pivot pin 132 relative to tube 18.

It will be appreciated by those skilled in the art that linkage 116 may, for example, be a boden cable or any other member known in the art, which will provide a pulling force on locking member 96. In addition, linkage 116 may be secured to tube 18 by any means known in the art. Similarly, locking member 96 may engage first connector 44 by any other means known in the art.

Figure 9:
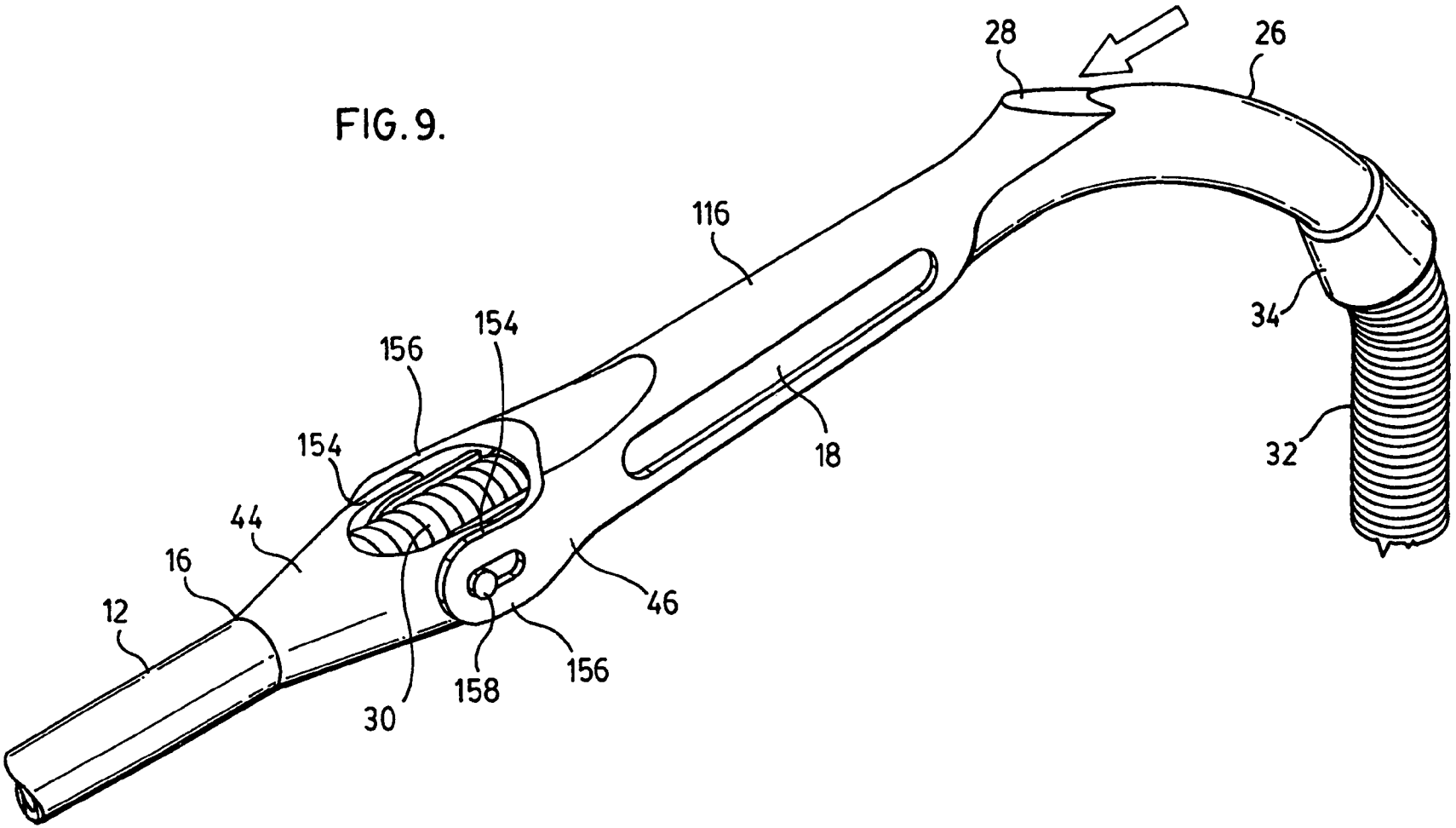

A further alternate embodiment is shown in FIG. 9. As shown therein, first connector 44 is secured to downstream end 16 of tube 12 and is generally Y-shaped, having two opposed flanges 154. Similarly, second connector 46 is secured to upstream end 20 of tube 18 and has a Y-shaped end having opposed flanges 156 which, when assembled, overlies flanges 154. Each pair of flanges 154, 156 may be secured together by a pivot pin 158.

It will be appreciated that various different constructions may be utilized for first and second connectors 44, 46. In particular, connectors 44, 46 may be formed as part of tubes 12 and 18 or may be separate members that are manufactured separately and then attached thereto. In any such case, connectors 44, 46 are associated with tubes 12 and 18 and provide the movable joint. Accordingly, when connectors 44, 46 move with respect to each other, tubes 12 and 18 move with respect to each other. It will be appreciated that movements other than pivotal may be utilized. For example, one member 44, 46 may translate as well as rotate with respect to the other connector 44, 46.

In addition, an actuator may be provided adjacent the lock or distal thereto. If the actuator is provided distal to the lock, then it is preferably positioned proximate the handle. Preferably, the actuator is positioned such that a user may release the lock while holding the handle.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with the specific embodiments hereof, it is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available to the present invention.

The invention claimed is:

1. A wand comprising:

(a) an upstream rigid tube having an upstream end and a downstream end;

(b) a downstream rigid tube having an upstream end and a downstream end, the downstream rigid tube releasably pivotally connected to the upstream rigid tube;

(c) wherein the downstream end of the upstream rigid tube has a first connector associated therewith and the upstream end of the downstream rigid tube has a second connector associated therewith, the first and second connectors being pivotally connected together;

(d) a flexible fluid flow conduit connecting the upstream end of the downstream rigid tube in fluid flow communication with the downstream end of the upstream rigid tube;

(e) a lock securing the upstream and the downstream rigid tubes in a fixed orientation, the lock comprising a member extending from at least one of the downstream rigid tube and the second connector and releasably engageable with at least one of the upstream rigid tube and the first connector; and (f) a lock release actuator positioned proximate the downstream end of the downstream rigid tube, the lock release actuator configured to actuate the lock.

2. The wand of claim 1 further comprising a handle associated with the downstream rigid tube and the lock release actuator is positioned proximate the handle.

3. The wand of claim 2 wherein the handle is positioned proximate the downstream end of the downstream rigid tube.

4. The wand of claim 3 wherein the upstream rigid tube is pivotally connected to the downstream rigid tube at a position proximate the upstream end of the downstream rigid tube.

5. The wand of claim 1 wherein the first connector is secured to the upstream rigid tube and the second connector is secured to the downstream rigid tube.

6. A surface cleaning apparatus including the wand of claim 1.

7. A wand comprising:

(a) an upstream rigid tube having a fluid flow passage having an upstream end and a downstream end;

(b) a downstream rigid tube having a fluid flow passage having an upstream end and a downstream end;

(c) the downstream rigid tube being moveably connected to the upstream rigid tube between a first position in which the upstream rigid tube is positioned in a fixed orientation with respect to the downstream rigid tube, and a second position in which the upstream rigid tube is at an angle to the downstream rigid tube;

(d) a flexible fluid flow conduit extending between the upstream end of the fluid flow passage of the downstream tube and the downstream end of the fluid flow passage of the upstream tube, the downstream end of the upstream rigid tube having a first connector associated therewith and the upstream end of the downstream rigid tube having a second connector associated therewith, the first and second connectors pivotally connected together;

(e) a lock releasably securing the upstream and the downstream rigid tubes in the first position, the lock comprising a member extending from at least one of the downstream rigid tube and the second connector and releasably engageable with at least one of the upstream rigid tube and the first connector; and (f) a lock release actuator positioned proximate the downstream end of the downstream rigid tube, the lock release actuator configured to actuate the lock.

8. The wand of claim 7 wherein the upstream rigid tube is pivotally connected to the downstream rigid tube.

9. The wand of claim 7 further comprising a handle associated with the downstream rigid tube and the lock release actuator is positioned proximate the handle.

10. The wand of claim 9 wherein the handle is positioned proximate the downstream end of the fluid flow passage of the downstream rigid tube.

11. The wand of claim 10 wherein the upstream rigid tube is pivotally connected to the downstream rigid tube at a position proximate the upstream end of the fluid flow passage of the downstream rigid tube.

12. The wand of claim 7 wherein the first connector is secured to the upstream rigid tube and the second connector is secured to the downstream rigid tube.

13. A surface cleaning apparatus including the wand of claim 7.

* * * * *